US005839402A

United States Patent [19]

Mori et al.

[11] Patent Number: 5,839,402

[45] Date of Patent: Nov. 24, 1998

[54] WEAR RESISTANT TAPPET

[75] Inventors: Akiyoshi Mori, Yokohama; Nobuo Hara, Fujisawa; Satoshi Fukuoka, Atsugi; Tatsuo Kanzaki, Fujisawa, all of Japan

[73] Assignee: Fuji Oozx Inc., Japan

[21] Appl. No.: 901,982

[22] Filed: Jul. 29, 1997

[51] Int. Cl.[6] ..... F01L 1/16

[52] U.S. Cl. ..... 123/90.51; 74/569

[58] Field of Search ..... 123/90.48, 90.51; 74/569

[56] References Cited

U.S. PATENT DOCUMENTS 4,909,198 3/1990 Shiraya et al. ..... 123/90.51
5,289,804 3/1994 Mori ..... 123/90.51
5,562,076 9/1997 Ohtsubo et al. ..... 123/90.51
5,596,959 1/1997 Kenmoku et al. ..... 123/90.51
5,605,122 2/1997 Hara et al. ..... 123/90.51

*Primary Examiner*—Weilun Lo
*Attorney, Agent, or Firm*—Hoffman, Wasson & Gitler

[57] ABSTRACT

A tappet made of Al alloy is used in a valve operating mechanism of an internal combustion engine of a vehicle. On the whole outer circumferential surface of the tappet, a helical projection and a helical groove are formed alternately to form an uneven surface. A plurality of uneven surfaces are formed on a ridge of the projection at regular intervals. The outer circumferential surface is coated with a wear resistant Fe film by thermal spraying. The uneven surfaces on the projection provide high adhesion strength of the film to the outer circumferential surface of the tappet to improve peel resistance, thereby increasing durability and reliability of the Al alloy tappet.

6 Claims, 5 Drawing Sheets

WEAR RESISTANT TAPPET

BACKGROUND OF THE INVENTION

The present invention relates to a wear resistant cylinder such as an Al alloy tappet in which the outer circumferential surface is coated with a hard film, and a method of manufacturing it.

A tappet body used in a direct acting type valve operating mechanism in an internal combustion engine is generally formed from Fe material such as steel and cast iron. Recently, in order to lighten the valve operating system, it is inclined to be made of Al alloy.

However, Al alloy tappet provides lower mechanical strength and lower wear resistance than Fe material. Thus, when the tappet is inserted in a cylinder head made of the same material, Al alloy, the sliding surface is likely to wear earlier or to cause scoring.

To solve the problem, the outer circumferential surface of Al alloy tappet may be coated with wear resistant material which is different from a base metal. If the outer circumferential surface of the base metal is flat, adhesion strength of the wear resistant material is low, and high peel resistance is not available, so that it is necessary to perform preliminary treatment for the base metal to make the whole outer circumferential surface of the tappet to a rough surface.

To make the rough surface, blasting is generally applied, but for the treatment, it is necessary to employ a specialized blasting apparatus, which takes a long time to involve low productivity and high consumption of blasting material, thereby increasing manufacturing cost.

To overcome the problem, U.S. Pat. No. 5,605,122 issued to Nobuo Hara et al. discloses a tappet in which the outer circumferential surface is made to a rough surface by simple means and is coated with wear resistant material.

Describing the invention in the U.S. Patent, as shown in FIG. 10 of an attached drawing, the whole outer circumferential surface of Al alloy cylindrical tappet is made to a threaded uneven surface 2 which comprises a projection 2*a* and a groove 2*b*, and is thermally sprayed to form a film 3.

The whole outer circumferential surface of the tappet body comprises the uneven surface 2 and the film 3 thereon. The projection 2*a* and groove 2*b* provide high adhesion strength of the film 3 to the base metal to improve peel resistance in an axial direction. But, in a circumferential direction, there is neither adhesiveness nor frictional resistance by the projection and groove, so that high peel resistance is not obtained, thereby providing low durability or reliability of the tappet.

SUMMARY OF THE INVENTION

To overcome the foregoing problem, it is an object of the present invention to provide a wear resistant cylinder such as an Al alloy tappet and a method of manufacturing it in which a projection and a groove of the outer circumferential surface of the cylinder is modified in form, thereby improving peel resistance of a film to a base metal in both axial and circumferential directions.

According to one aspect of the present invention, there is provided a wear:resistant cylinder which comprises a cylinder body; a projection on an outer circumferential surface of the cylinder body; a groove which is formed adjacent to the projection on the outer circumferential surface of the cylinder body; and a wear resistant film with which the projection and the groove on the outer circumferential surface are coated, a recess being formed on a ridge of the projection.

Not only in the axial direction of the cylinder body but also in the circumferential direction, peel resistance of the film is improved, thereby increasing durability and reliability of the cylinder.

According to another aspect of the present invention, there is provided a method of manufacturing a cylinder, the method comprising the steps of forming a projection and a groove alternately on an outer circumferential surface of a cylinder body, an uneven surface being formed on a ridge said projection at the same time, and coating the outer circumferential surface of the cylinder body with a wear resistant film.

It avoids conventional blasting, thereby facilitating manufacturing of the cylinder, such as a tappet, and decreasing cost.

According to a further aspect of the present invention, there is provided a method of manufacturing a wear resistant cylinder, the method comprising the steps of forming a projection and a groove on an outer circumferential surface of a cylinder body; cutting off a ridge of the projection by a suitable length in a circumferential direction to form an uneven surface; and coating the outer circumferential surface of the cylinder body with a wear resistant film.

According to a still further aspect of the present invention, there is provided a method of manufacturing a cylinder, the method comprising the steps of forming an optional groove on an outer circumferential surface of a cylinder body; pressing a sharp cutting tool against the outer circumferential surface of the cylinder body to move the cutting tool in an axial direction to form a helical groove and a helical projection which has an uneven surface on a ridge while the cylinder body is rotated; and coating the outer circumferential surface of the cylinder body with a wear resistant film.

The recess is formed without fail, thereby increasing reliability.

BRIEF DESCRIPTION OF THE DRAWINGS

The features and advantages of the present invention will become more apparent from the following description with respect embodiments as shown in the drawings wherein.

DETAILED DESCRIPTION OF PREFERRED EMBODIMENTS

Figure 1A:
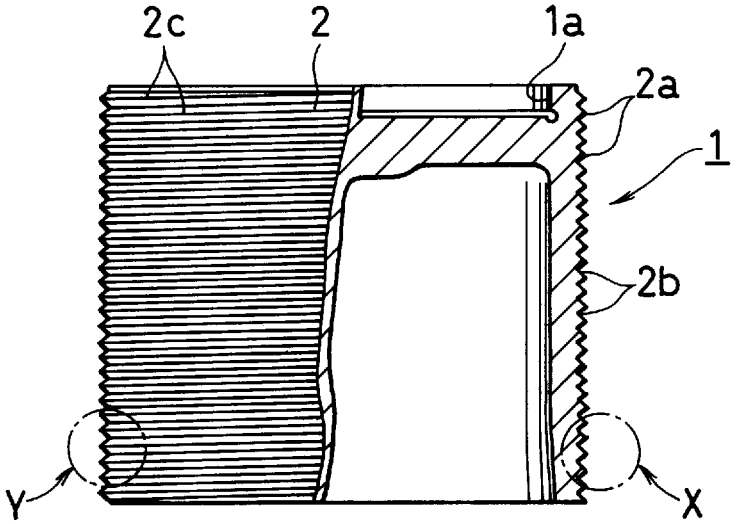
FIGS. 1(A) and (B) show an embodiment of the first method in order of steps, (A) being a partially vertical sectioned front view of a tappet body which has a helical projection and groove on the outer circumferential surface, (B) being a partially vertical sectioned front view which shows the outer circumferential surface onto which a film is thermally sprayed.
Figure 1B:
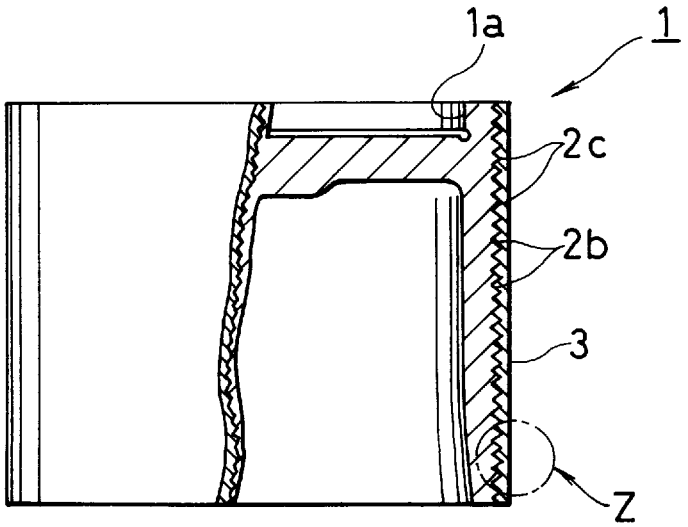

FIG. 1 (A) and (B) illustrate a method of the present invention in order of steps.

A cylindrical tappet body 1 is made of conventional Al alloy such as A1—Si—Cu, and has a bore la in which a shim (not shown) made of wear resistant metal fits, on the upper surface.

Figure 2:
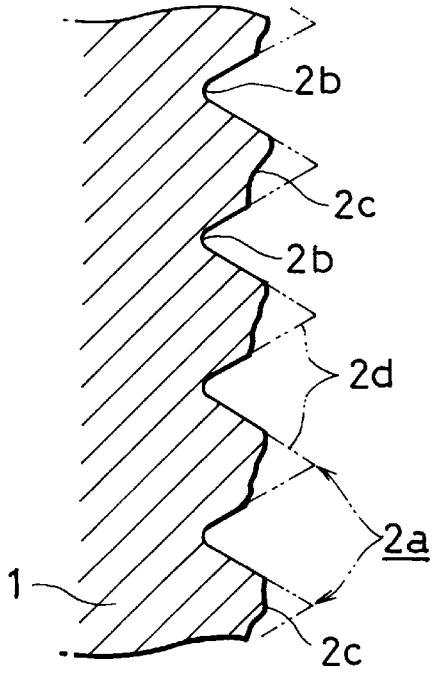
FIG. 2 is an enlarged view of a portion (X) in FIG. 1.
Figure 3:
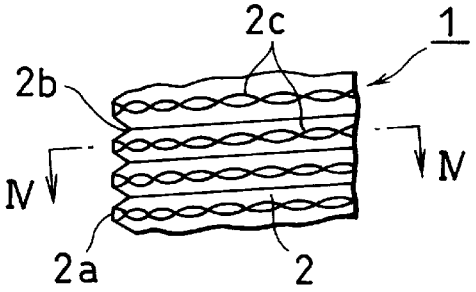
FIG. 3 is an enlarged view of a portion (Y) in FIG. 1.
Figure 4:
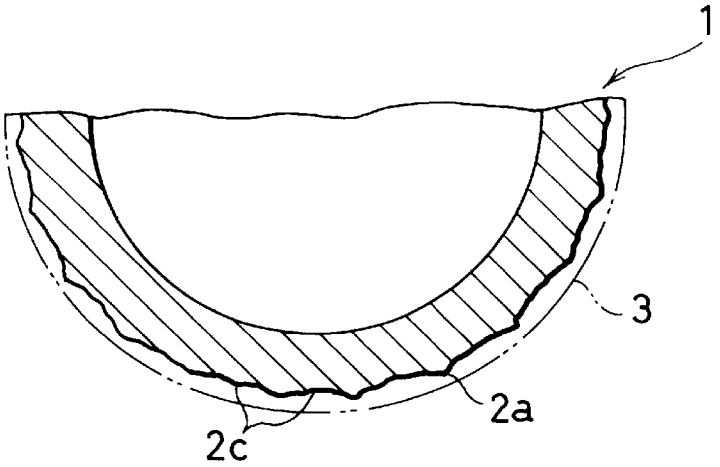
FIG. 4 is a horizontal sectional plan view taken along the line IV—IV in FIG. 3.

As shown in FIG. 1(A), the outer circumferential surface of the tappet body 1 comprises an uneven surface 2 which comprises a helical projection 2*a* and groove 2*b* having a predetermined pitch, and as shown on an enlarged scale in FIGS. 2 to 4, an uneven surfaces 2*c* are formed on the projection 2*a* at regular intervals, such as 0.1 to 3 mm in a circumferential direction.

To form the projection 2*a*, groove 2*b* and uneven surfaces 2*c*, there is a method as follows.

The first method is a method of forming the projection 2*a*, groove 2*b* and uneven surfaces 2*c* simultaneously. As shown on an enlarged scale in FIG. 5, the tappet body 1 is held horizontally by a chuck (not shown) and is rotated at fixed speed, and a sharpened threading tool 4 is pressed against the outer circumferential surface of the tappet body 1. The threading tool 4 is moved in a direction of an arrow, i.e. in an axial direction, so that the surface of the tappet body 1 is cut to form the helical projection 2*a* and groove 2*b*.

Figure 5:
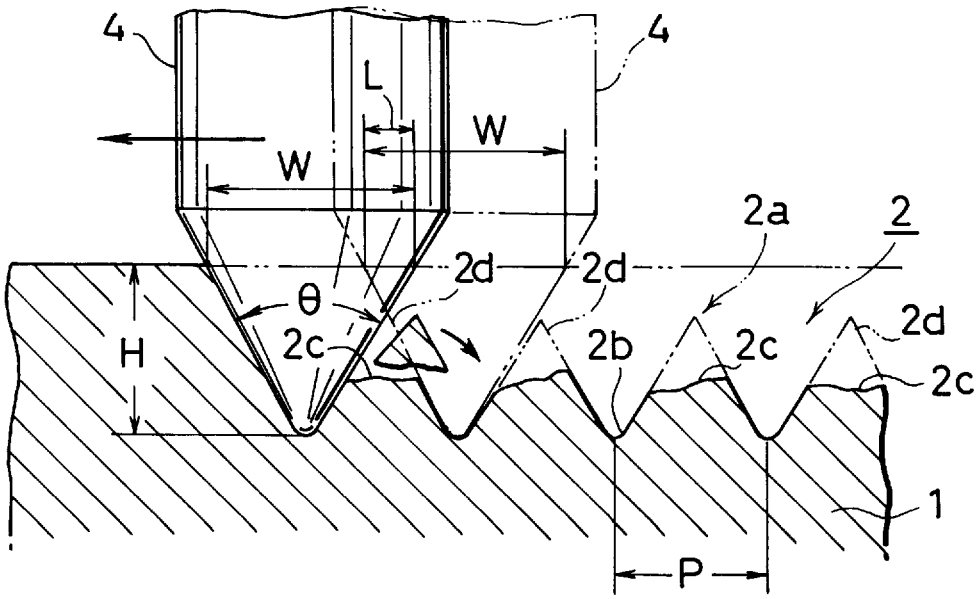
FIG. 5 is an enlarged sectional view which shows how to form a projection, a groove and an uneven surface.

To overlap a circumferential cutting width "W" partially formed by the cutting tool 4, or to form an overlapping portion "L" as shown in FIG. 5, by suitably determining depth "H" of cut on the surface of the tappet body 1 by the cutting tool 4, an opening angle "θ" of the cutting tool 4, and an axial feed rate of the cutting tool 4 per one rotation of the tappet body 1 or a pitch "P" of the projection 2*a* or groove 2*b*, a ridge of the projection 2*a* is discontinuously chipped in a direction contrary to a feed direction of the cutting tool 4 to form a plurality of discontinuous uneven surface 2*c*.

To form the overlapping portion "L", the relationship among the depth "H" of cut, the opening angle "θ" and the pitch "P" may be set to $H \tan\theta/2 \geqq P/2$.

The inventors of the present invention confirmed that the uneven surface was formed on the outer circumferential surface of the tappet body 2 having a diameter of 20 to 50 mm to form the uneven surface 2*c* easily by setting the opening angle θ of the cutting tool 4° to 30° to 90°, the overlapping portion "L" to 0.05 to 0.35 mm, a rake angle to 20°, a back clearance angle to 25°, the pitch "P" of the projection and groove to 0.10 to 1.00 mm and the depth of cut to 0.25 to 0.80 mm.

The following is presumed. As mentioned above, the pitch decreases compared with conventional threading, a suitable overlapping portion "L" is provided between the cutting width "W" of the cutting tool 4, so that axial thickness of the ridge 2d of the projection 2*a* decreases. Further, the ratio of the depth "H" of cut to the pitch "P" increases and the diameter of the ridge of the projection 2*a* is made to be smaller than the diameter of the tappet body 1, so that reaction force in a contrary direction to feed by cutting resistance is applied to the cutting tool 4. Thus, in the tappet body 1 made of low toughness Al alloy, the ridge 2*d* is pressed by the reaction force, and the uneven surface 2*c* is formed by being cut off in a circumferential direction.

Figure 6:
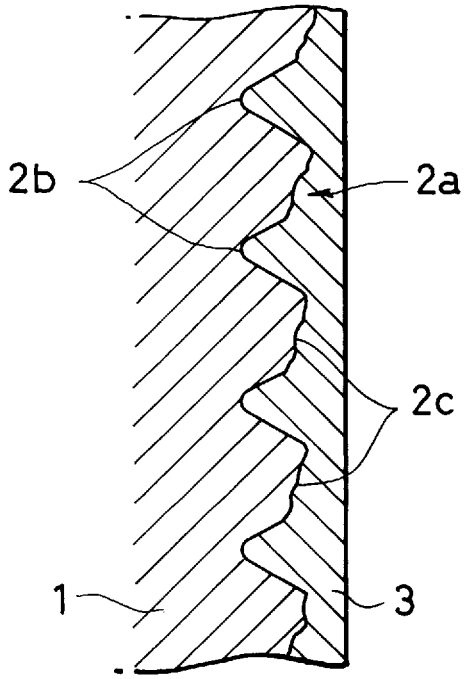
FIG. 6 is an enlarged view of a portion (Z) in FIG. 1.

The outer circumferential surface of the tappet body 1 is formed as a roughened surface, and as shown in FIG. 1 (B), wear resistant metal such as Fe is thermally sprayed to the outer circumferential surface which comprises a roughened surface to form a film 3. The film 3 is formed as above, thereby making a tappet which provides not only axial but also circumferential high peel resistance of the film 3. There is a problem that adhesion strength of the film 3 is conventionally low in a circumferential direction, but as shown in FIGS. 4 and 6, according to the present invention, thermal spraying material is coated onto the plurality of uneven surfaces 2*c* formed on the projection 2*a*, thereby providing high adhesion effect of the film 3 in the circumferential direction to cause high peel resistance.

The uneven surfaces of the recesses 2*c* which are formed by cutting off the ridges 2*d* are not as smooth as mechanically processed surfaces, but are irregularly roughened, thereby providing suitable peel resistance to the film 3 thermally sprayed onto the surface, which is advantageous.

The second method comprises the steps of forming the projection 2*a* and the groove 2*b* and, thereafter, cutting off the ridge 2*d* of the projection 2*a* at a suitable length in a circumferential direction to form the uneven surfaces at regular intervals.

Figure 7:
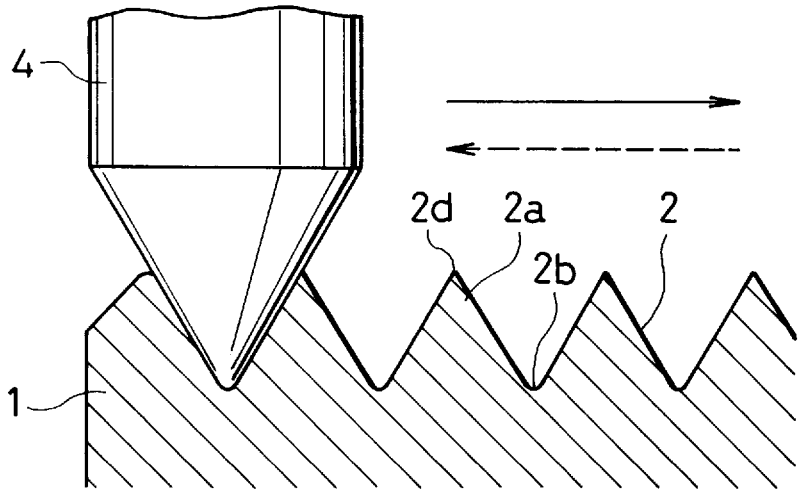
FIG. 7 is a sectional view similar to FIG. 5, showing an embodiment of the second manufacturing method.

The second method comprises the steps of forming the helical projection 2*a* and groove 2*b* on the outer circumferential surface of the tappet body 1 by pressing and moving the cutting tool 4 on the outer circumferential surface of the tappet body 1 in an axial direction of the tappet body 1 while the tappet body 1 is rotated at fixed speed, and thereafter by moving the cutting tool 4 in a contrary direction (as shown by a solid arrow in FIG. 7) to a formerly moving direction (as shown in a broken arrow in FIG. 7) to form uneven surfaces (not shown) at regular intervals on the ridge 2*d* of the projection 2*a* by the cutting tool 4.

The pitch in returning the cutting tool 4 may be equal to the pitch "P" in going forth, but preferably may be significantly larger than it.

When the relationship among the depth of cut "H", the opening angle "θ" and the pitch "P" is set to $H \tan\theta \geqq P/2$ in a forwarding path, the irregular uneven surfaces 2*c* as above are formed on the ridge 2*d* of the projection 2*a* with cutting of the projection 2*a*. Further, when the cutting tool 4 returns, deeper recesses are formed on the ridge 2*d* by the cutting tool 4. Two kinds of shallower and deeper recesses improve circumferential peel resistance of the film thermally sprayed thereafter.

Figure 8:
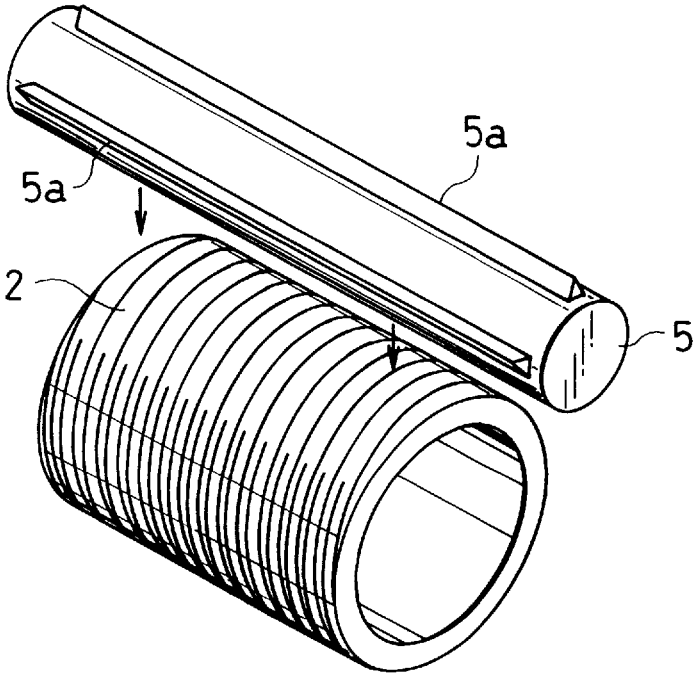
FIG. 8 is a perspective view of another embodiment of the second manufacturing method.

As another embodiment of the second method, while the tappet body 1 is rotated at fixed speed similar to the above, the sharp cutting tool 4 is pressed against the outer circumferential surface of the tappet body 1 to move the tappet body 1 in an axial direction, thereby forming the helical projection 2*a* and groove 2*b* on the outer circumferential surface of the tappet body 1. Thereafter, as shown in FIG. 8, onto the outer circumferential surface having unevenness, a pressing roller 5 on which a plurality of protrusions 5*a* extends axially (or in a direction crossed to the projection) is put in parallel with the tappet body 1 and pressed onto it. The pressing roller 5 and the tappet body 1 are rotated at the same circumferential speed in a contrary direction, recesses (not shown) are formed at regular intervals on the ridge 2*d* of the projection 2*a* by the protrusions 5*a* of the pressing roller 5.

According to this method, the ridge 2*d* of the projection 2*a* are pressed by the protrusions 5*a* of the pressing roller 2*a* to form the uneven surfaces. Burrs (not shown) which are formed at the edges of the uneven surfaces to prevent a film thermally sprayed thereafter from peeling off, thereby increasing peel resistance of the film, which is advantageous.

As a method of forming uneven surfaces on the ridge 2*d* of the projection 2*a*, in addition to the method which uses the pressing roller 5, there is a method of moving a thinner grinding wheel or a milling tool in an axial direction which is perpendicular to the projection 2*a*. Any of the methods may be applied.

In the third method, an optional groove is formerly formed on the outer circumferential surface. Thereafter, while the tappet body 1 is rotated around its axis, a sharp cutting tool is pressed against the outer circumferential surface to move the tappet body 1 axially, thereby forming a groove and a projection which has recesses at regular intervals on its ridge.

Figure 9:
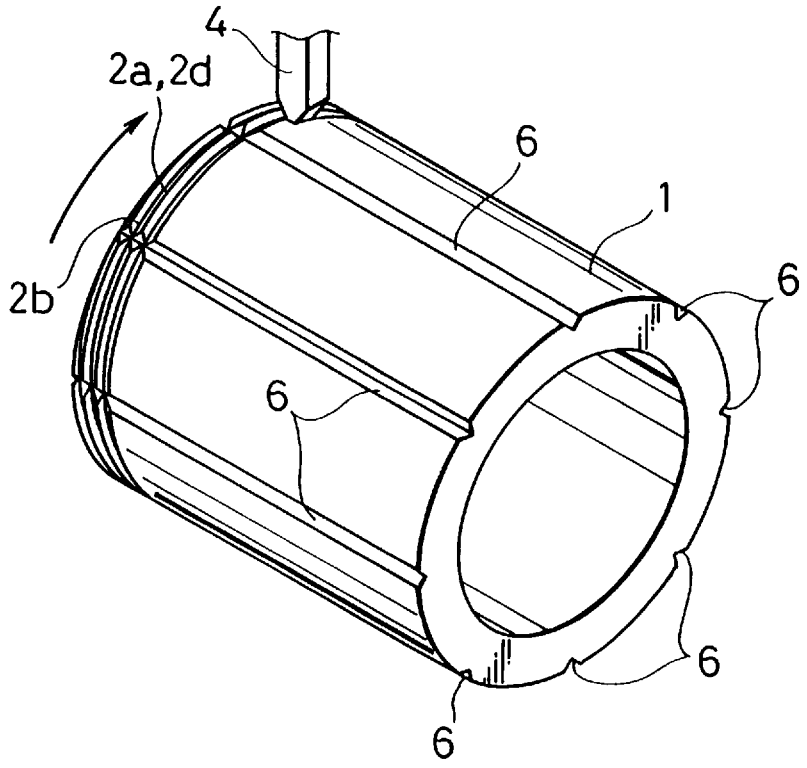
FIG. 9 is a perspective view of an embodiment of the third manufacturing method.
Figure 10:
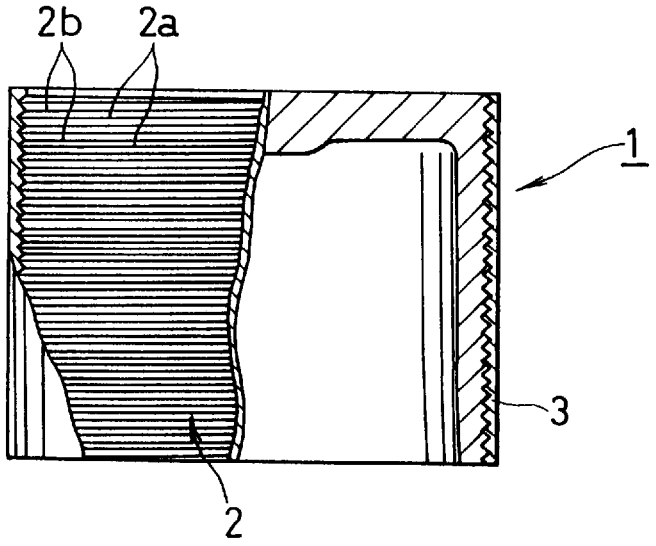
FIG. 10 (PRIOR ART)
FIG. 10 is a partially vertical sectional view which shows a conventional method of manufacturing a tappet.

For example, as shown in FIG. 9, on the outer circumferential surface of the tappet body 1, a plurality of V-sectioned grooves which extend axially are formed by a rotary grindstone or a milling machine (not shown) at suitable intervals in a circumferential direction. Thereafter, similar to what is shown in FIG. 5, while the tappet body 1 is rotated around its axis, a sharp cutting tool 4 is pressed against the outer circumferential surface of the tappet body 1 to form uneven surfaces at regular intervals on a ridge 2*d* of a helical projection 2*a*.

Thereafter, similarly, a film is formed on the outer circumferential surface of the tappet body 1 by thermal spraying. Similar advantages to the second method can be achieved according to the third method. The present invention is not limited to the foregoing embodiments. For example, in the foregoing embodiments, the projection 2*a* and the groove 2*b* are helical, but a plurality of annular projections and grooves spaced in parallel to each other may be formed, and a plurality of uneven surfaces may be formed on the annular projections 2*a*. Instead of the above thermal spraying, the film 3 may be formed by plating or coating means. The present invention may be applied to an air cylinder, a piston of a hydraulic cylinder, a piston of an internal combustion engine, etc. in addition to an Al alloy tappet.

The foregoings merely relate to preferred embodiments of the present invention. Various changes and modifications may be made by person skilled in the art without departing from the scope of claims wherein:

What is claimed is:

1. A tappet for an internal combustion engine, the tappet comprising:

a cylindrical body formed of an aluminum alloy, a helical projection formed on the outer circumferential surface of the cylindrical body, a helical groove formed adjacent to the projection on the outer circumferential surface of the cylindrical body, a wear resistant film coating the helical projection and helical groove on the outer circumferential surface of the cylindrical body, and said projection terminating in uneven surfaces formed at the outer circumferential surface of said cylindrical body, said uneven surfaces imparting increased adhesion to said wear resistant coating.

2. A tappet as defined in claim 1 wherein said uneven surfaces are formed on each projection at regular intervals.

3. The tappet as defined in claim 1 wherein said uneven surfaces are formed by removing the ridges of the helical projections on the outer circumferential surface of the cylindrical body, thereby increasing peel resistance for each wear resistant coating in the circumferential direction.

4. The cylinder as defined in claim 1 wherein the film is formed by thermal spraying.

5. The cylinder as defined in claim 1 wherein the film comprises wear resistant metal.

6. The cylinder as defined in claim 5 wherein the wear resistant metal comprises Fe.

* * * * *